US006364732B1

(12) United States Patent
Wu

(10) Patent No.: US 6,364,732 B1
(45) Date of Patent: Apr. 2, 2002

(54) PINWHEEL

(76) Inventor: Pao-Chang Wu, 3F, No. 22, Lane 40, Second Pao An St., Su Lin Town, Taipei Hsien (TW)

( * ) Notice: Subject to any disclaimer, the term of this patent is extended or adjusted under 35 U.S.C. 154(b) by 0 days.

(21) Appl. No.: 09/721,208

(22) Filed: Nov. 22, 2000

(51) Int. Cl.[7] ..... A63H 33/40
(52) U.S. Cl. ..... 446/217; 446/242
(58) Field of Search ..... 446/217, 242

(56) References Cited

U.S. PATENT DOCUMENTS 1,645,702 A * 10/1927 Ischinger
2,510,336 A * 6/1950 Donahue
3,747,263 A * 7/1973 Grossberg
3,941,504 A * 3/1976 Snarbach

* cited by examiner

*Primary Examiner*—John A. Ricci
(74) *Attorney, Agent, or Firm*—Alan Kamrath; Rider, Bennett, Egan & Arundel, LLP

(57) ABSTRACT

A pinwheel has a plurality of curved blades, a lower rotating wheel, a decoration article, an upper rotating wheel, a shaft rod passing through the lower rotating wheel, the decoration article and the upper rotating wheel, and an illuminating lamp inserted in the shaft rod. The lower rotating wheel has a plurality of circular apertures. The upper rotating wheel has a plurality of round apertures. Two ends of each curved blade are inserted in the respective circular aperture and the respective round aperture.

1 Claim, 5 Drawing Sheets

PINWHEEL

BACKGROUND OF THE INVENTION

The present invention relates to a pinwheel. More particularly, the present invention relates to a pinwheel which has a decoration article and an illuminating lamp.

A conventional pinwheel has a shaft rod and a plurality of helical blades. However, the conventional pinwheel is easily broken.

SUMMARY OF THE INVENTION

An object of the present invention is to provide a pinwheel which will not be broken for a long period of usage.

Accordingly, a pinwheel comprises a plurality of curved blades, a lower rotating wheel, a decoration article, an upper rotating wheel, a shaft rod passing through the lower rotating wheel, the decoration article and the upper rotating wheel, and an illuminating lamp inserted in the shaft rod. The lower rotating wheel has a plurality of circular apertures. The upper rotating wheel has a plurality of round apertures. Two ends of each curved blade are inserted in the respective circular aperture and the respective round aperture.

DETAILED DESCRIPTION OF THE INVENTION

Figure 1:
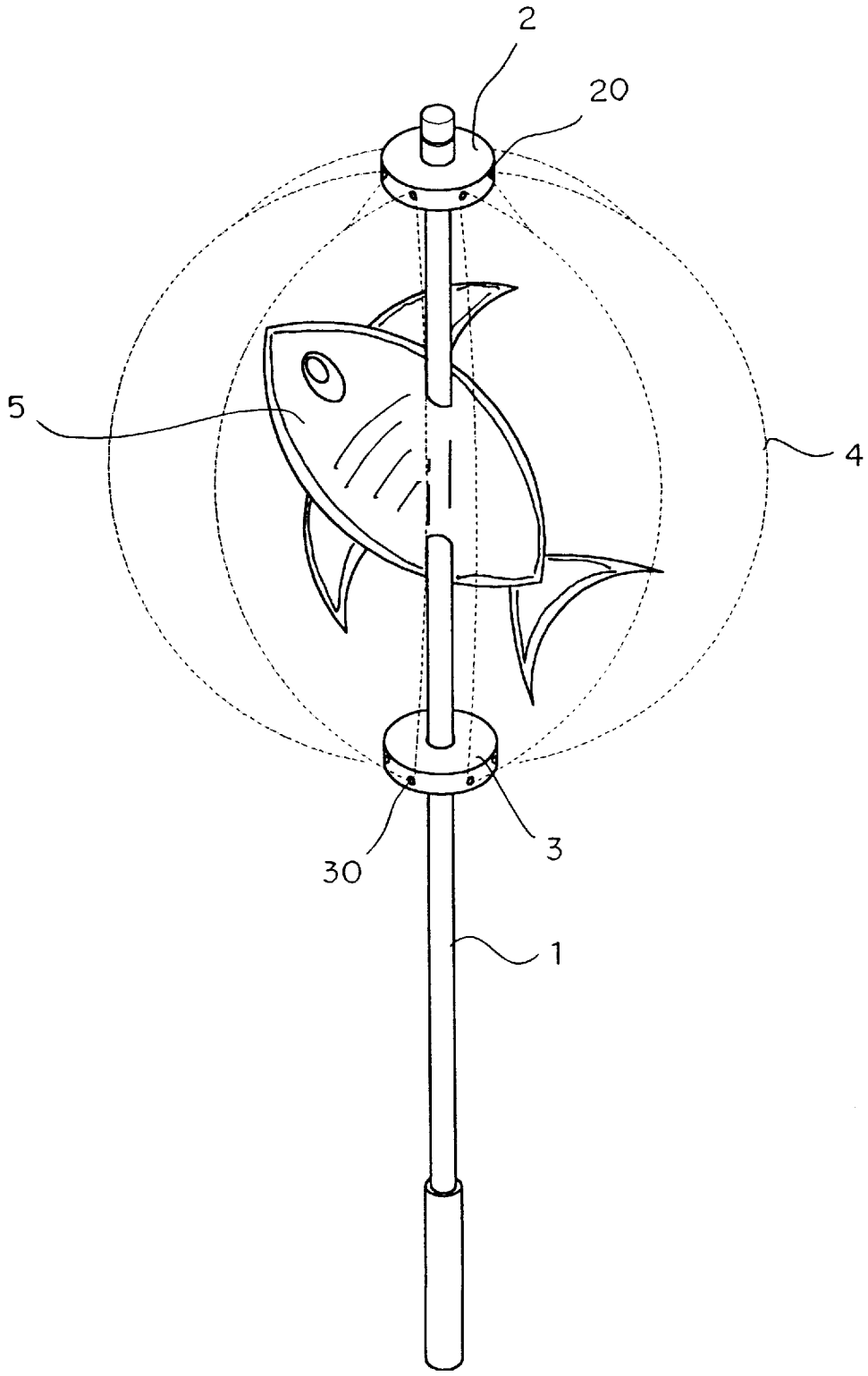
FIG. 1 is a perspective view of a pinwheel of a first preferred embodiment in accordance with the present invention.
Figure 2:
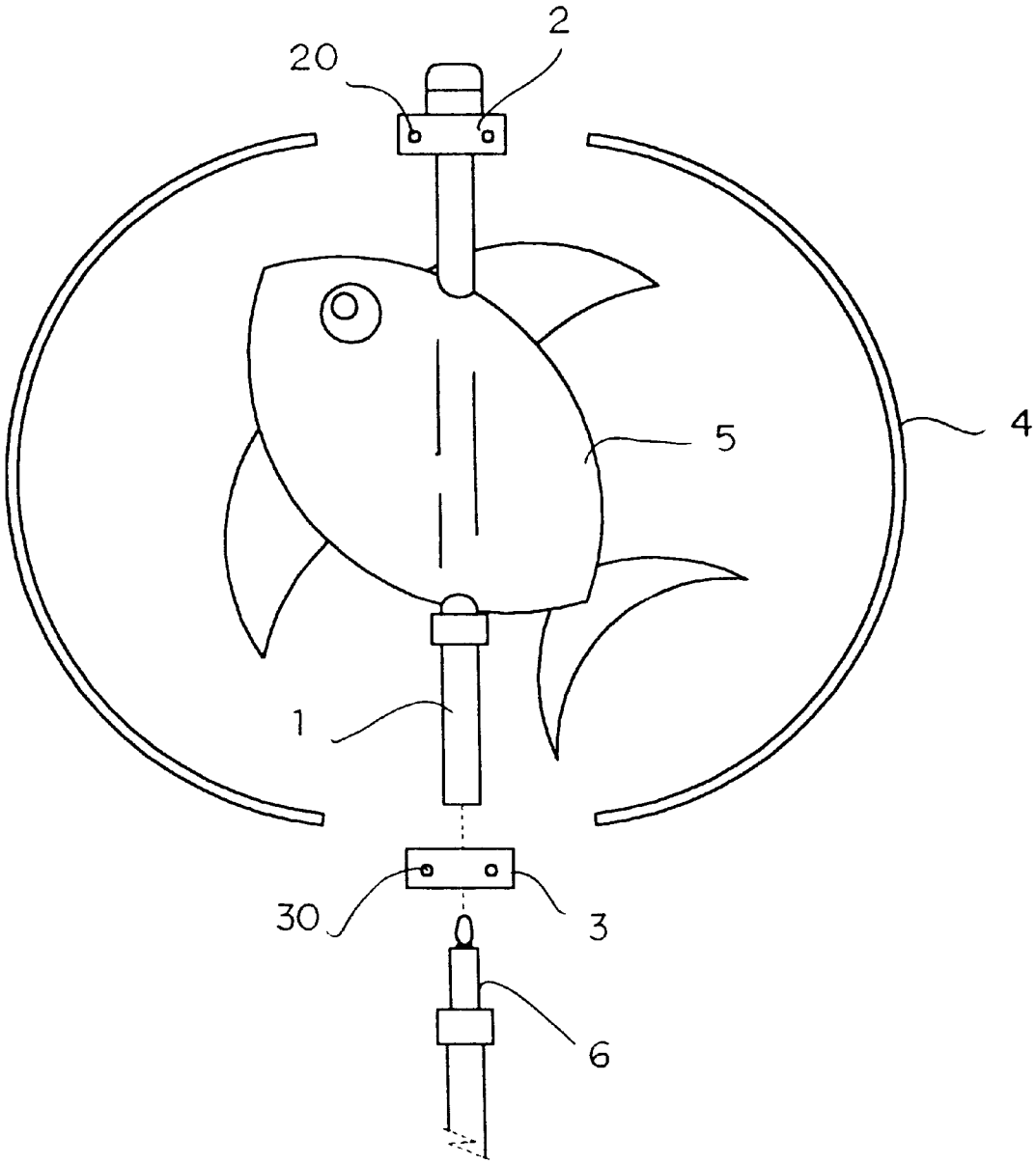
FIG. 2 is an elevational exploded view of a pinwheel of a first preferred embodiment in accordance with the present invention.
Figure 3:
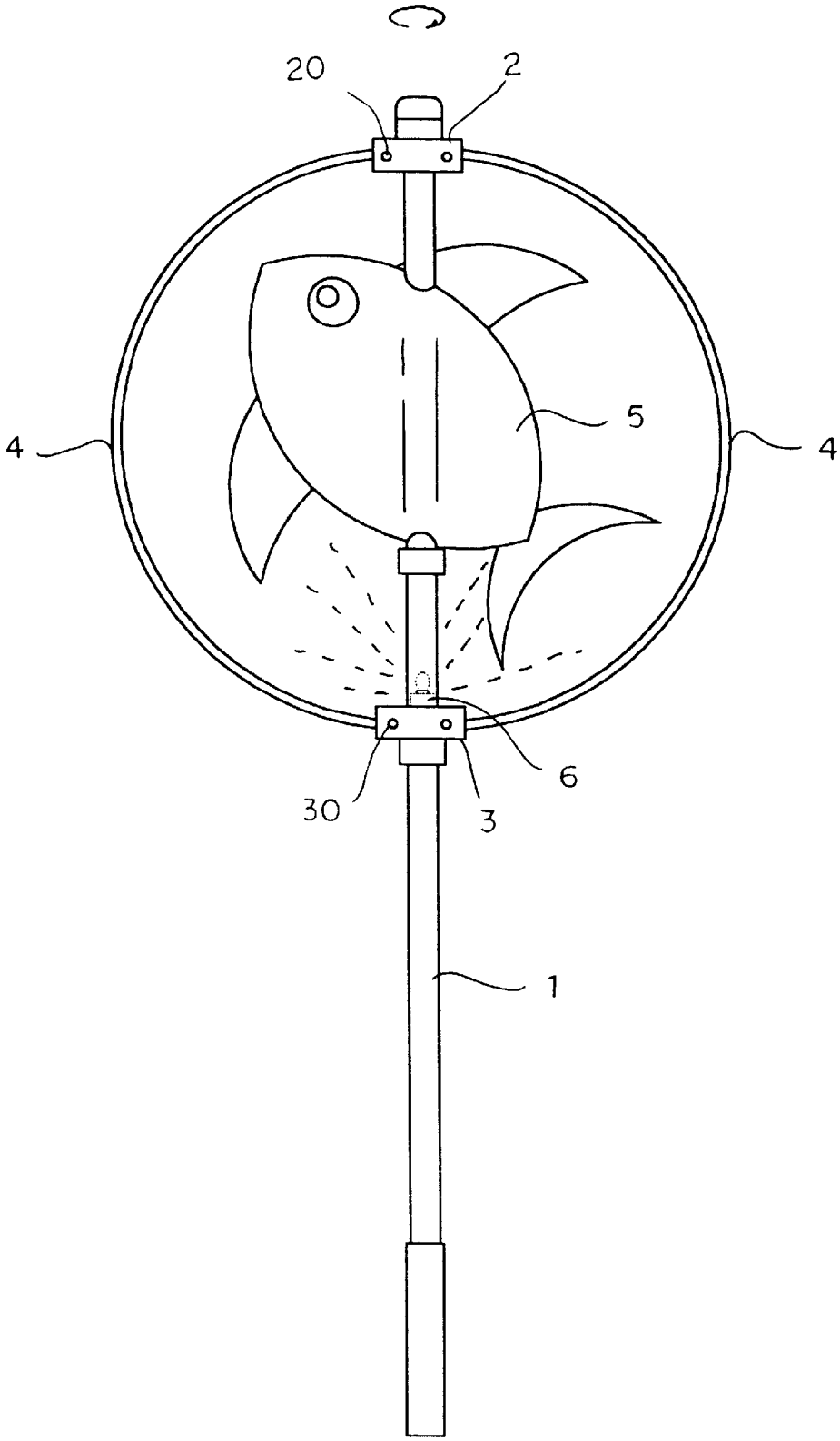
FIG. 3 is an elevational assembly view of a pinwheel of a first preferred embodiment in accordance with the present invention.

Referring to FIGS. 1 to 3, a pinwheel comprises a plurality of curved blades 4, a lower rotating wheel 3, a decoration article 5, an upper rotating wheel 2, a shaft rod 1 passing through the lower rotating wheel 3, the decoration article 5 and the upper rotating wheel 2, and an illuminating lamp 6 inserted in the shaft rod 1

The lower rotating wheel 3 has a plurality of circular apertures 30.

The upper rotating wheel 2 has a plurality of round apertures 20.

Two ends of each curved blade 4 are inserted in the respective circular aperture 30 and the respective round aperture 20.

Figure 4:
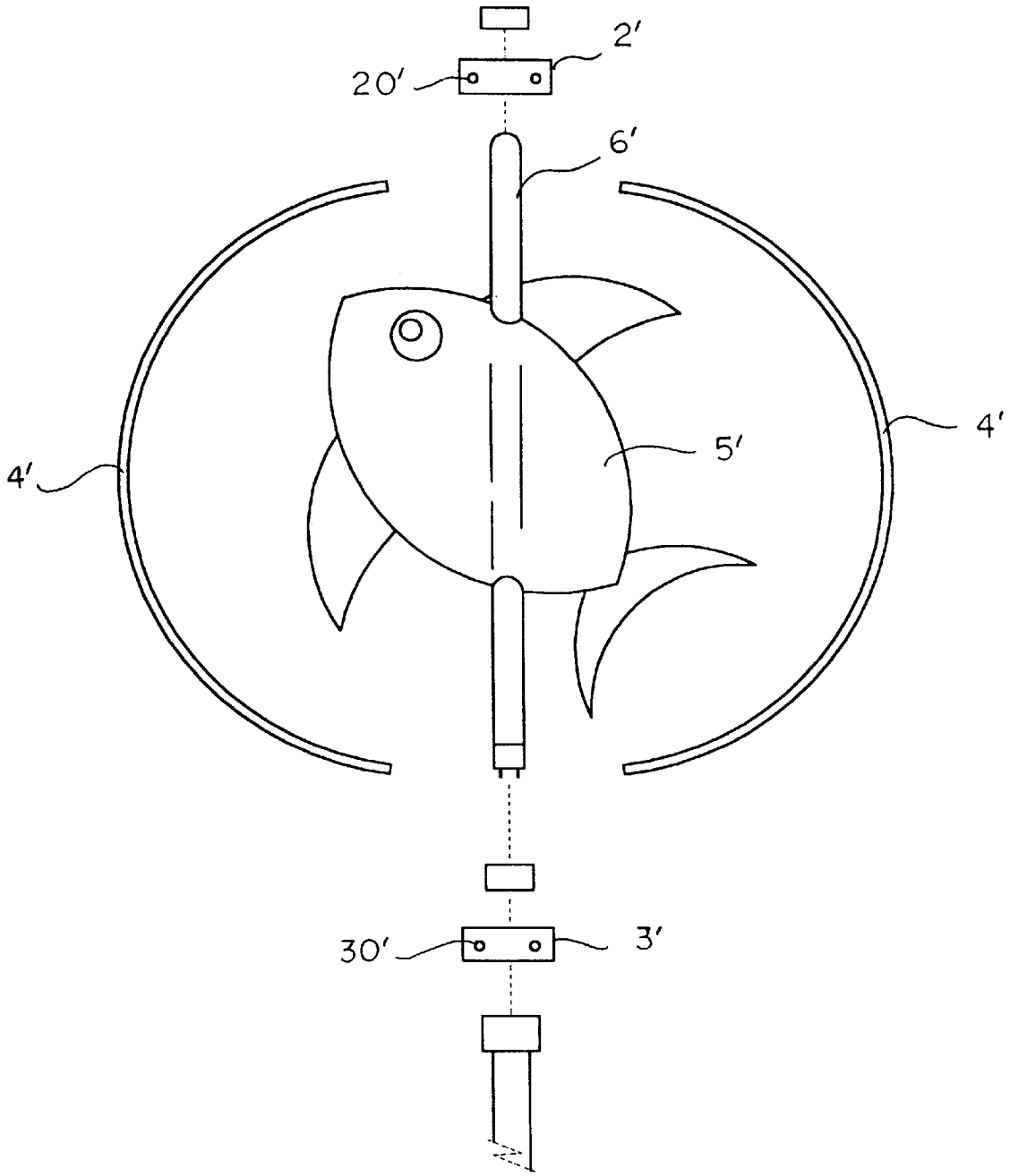
FIG. 4 is an elevational exploded view of a pinwheel of a second preferred embodiment in accordance with the present invention.
Figure 5:
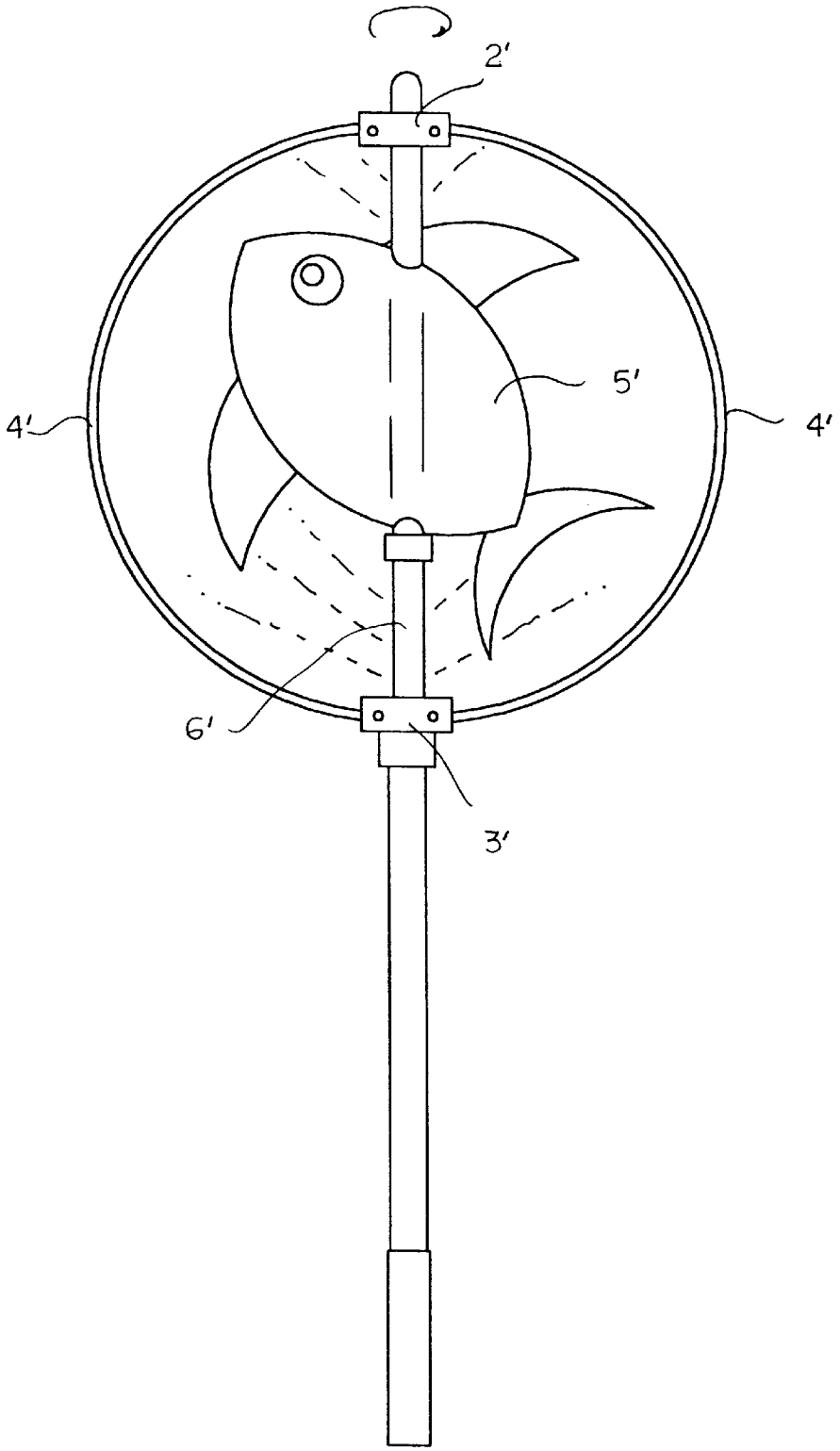
FIG. 5 is an elevational assembly view of a pinwheel of a second preferred embodiment in accordance with the present invention.

Referring to FIGS. 4 and 5, another pinwheel comprises a plurality of curved blades 4', a lower rotating wheel 3', a decoration article 5', an upper rotating wheel 2', and an illuminating shaft rod 6' passing through the lower rotating wheel 3', the decoration article 5' and the upper rotating wheel 2'.

The invention is not limited to the above embodiment but various modification thereof may be made. Further, various changes in form and detail may be made without departing from the scope of the invention.

I claim:

1. A pinwheel comprises:

a plurality of curved blades, a lower rotating wheel, a decoration article, an upper rotating wheel, a shaft rod passing through the lower rotating wheel, the decoration article and the upper rotating wheel, and an illuminating lamp inserted in the shaft rod, the lower rotating wheel having a plurality of circular apertures, the upper rotating wheel having a plurality of round apertures, and two ends of each said curved blade inserted in the respective circular aperture and the respective round aperture.

* * * * *